United States Patent [19]

Emslie

[11] Patent Number: 4,871,112

[45] Date of Patent: Oct. 3, 1989

[54] MONEY SAVINGS BOX

[76] Inventor: Grant C. Emslie, 579 Craven Road, Toronto, Ontario, Canada, M4L 2Z6

[21] Appl. No.: 189,115

[22] Filed: May 2, 1988

[51] Int. Cl.[4] ..... A47G 29/00

[52] U.S. Cl. ..... 232/4 R; 446/8

[58] Field of Search ..... 232/4 R, 1 D; 446/8

[56] References Cited

U.S. PATENT DOCUMENTS 1,403,328 1/1922 Keplinger ..... 232/4 R 1,415,168 5/1922 Gibbs ..... 232/4 R 3,104,052 9/1963 Nemsky ..... 232/4 R 3,298,601 1/1967 Brown ..... 232/4 R

*Primary Examiner*—Robert W. Gibson, Jr.

*Attorney, Agent, or Firm*—Blake, Cassels, Graydon

[57] ABSTRACT

The present invention concerns a money saving box, wherein independently rotatable combination rings each marked with different colors, symbols etc., allow, when positioned in a predetermined arrangement, to open or lock the box.

4 Claims, 3 Drawing Sheets

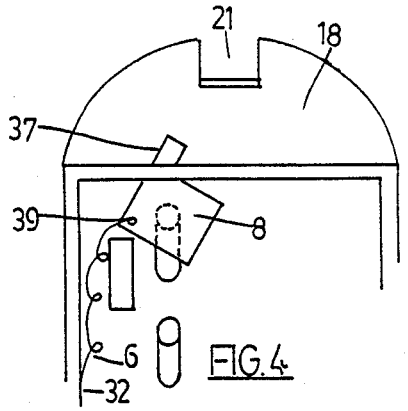
FIG. 4
FIG. 2
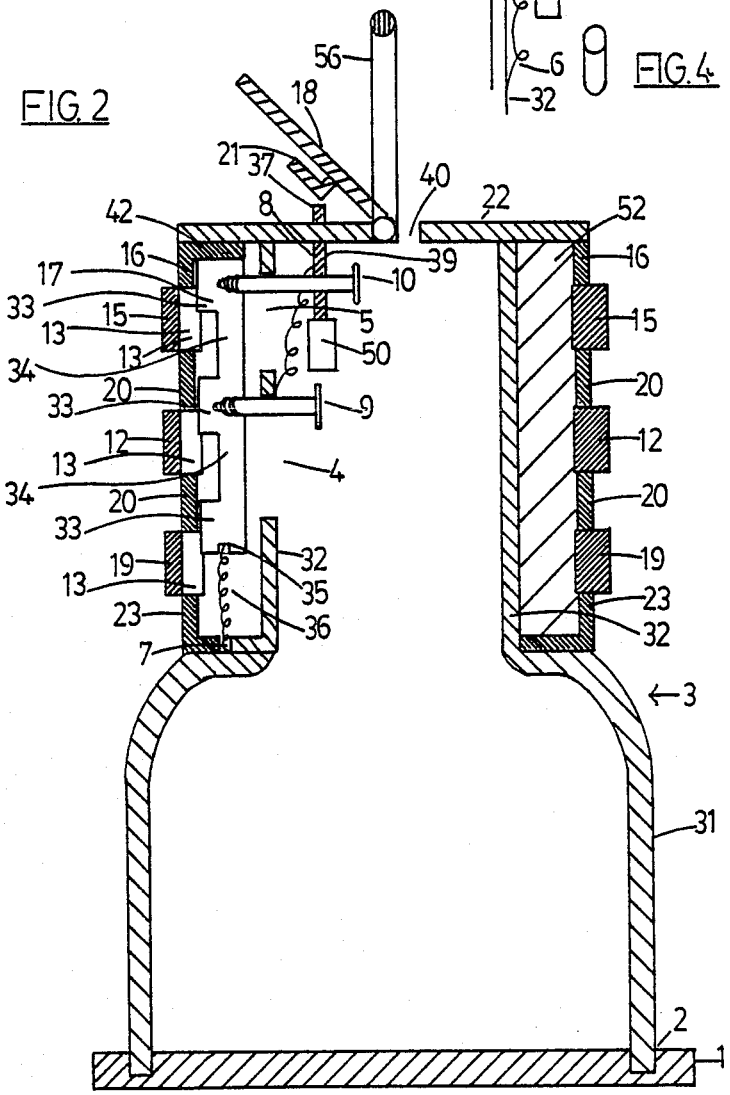

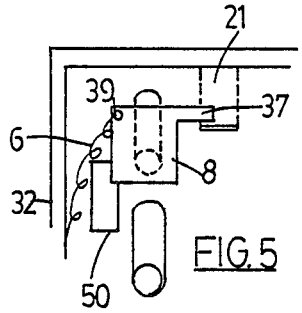
FIG. 5
FIG. 3
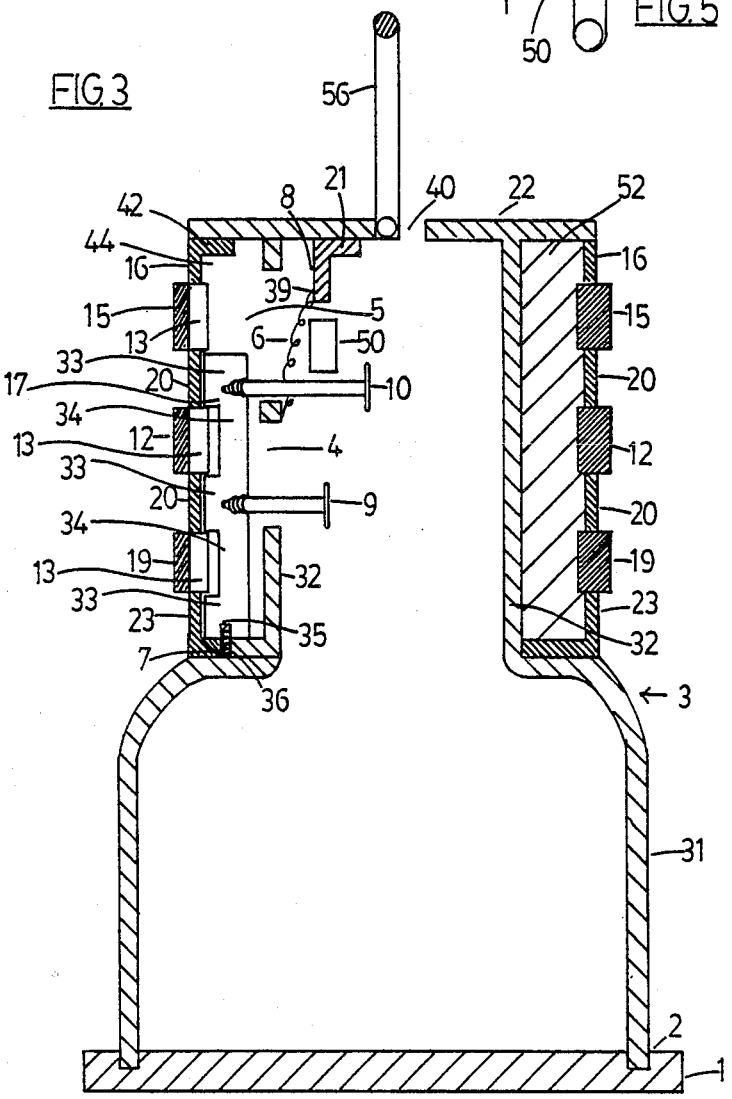

MONEY SAVINGS BOX

The present invention relates to a money saving box having a combination lock.

There are known in the art, keyless money boxes which use complicated and expensive mechanisms. The present invention aims to provide an improvement over such devices.

Accordingly, the invention provides a money saving box comprising a housing having an openable hinged lid at a top thereof and having an opening for the insertion of money; an elongate locking key including a shaft and wards and being vertically aligned with and slidable with respect to a cylindrical upper part of the housing, by means of upper and lower pegs of the key, respectively slidable in upper and lower similar oval apertures in the upper part of the housing; rotatable operating rings located around the upper part of the housing and the shaft of the key, the rings having slots to accomodate the wards of the key and indicia indicating alignment of the slots with the wards of the key, in which alignment the key is movable between an upper position and a lower position over a distance limited by the oval apertures, the key being spring biassed towards said upper position; and a latch pivotally arranged on the upper supporting peg such that, when the key is in said lower position, the latch is pivotally arranged to engage said lid, and such that, when the key is in said upper position, the latch is spring biassed to be pivotally arranged to disengage the lid.

The indicia on the rings may be any convenient indicia such as coloured areas, symbols, pictures or the like. The indicia may also be braille. Preferably other non-indicative indicia are provided.

An embodiment of the invention will now be described by way of example with reference to the drawings, in which:

FIG. 2, is a vertical section on the line II—II of FIG. 1,

FIG. 3, is a similar vertical section to that of FIG. 2 but with the lid closed;

FIG. 4 is a vertical section on the line IV—IV of FIG. 2; and

FIG. 5 is a verical section on the line V—V of FIG. 3.

Figure 1:
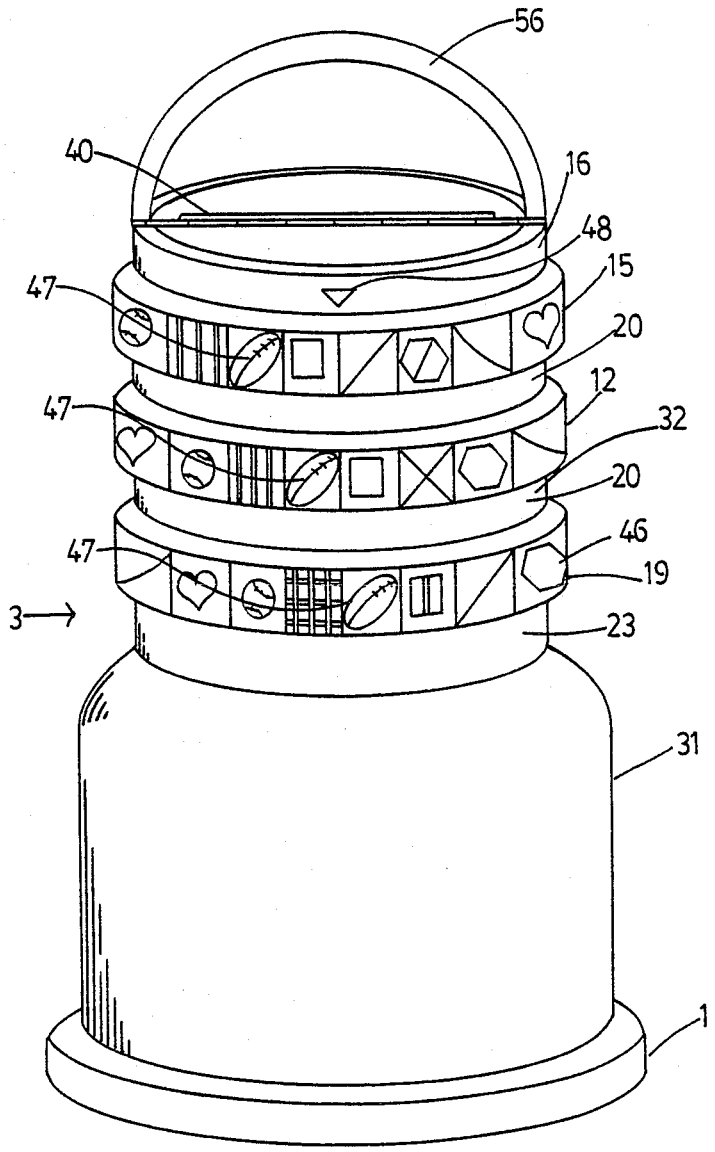
FIG. 1 is a perspective view of a money box according to the invention.

Referring now to the Figures, a money savings box comprises a flat round base 1 whose upper surface is provided with a circular groove 2, in which the bottom end of a cylinder 3 is inserted. The cylinder 3 comprises a lower part 31 and an upper part or neck 32 of reduced diameter. The neck 32 and the lower part 31 may have similar height so that each constitutes about half the height of the money box. The neck 32 is provided with two vertically spaced oval apertures 4, 5 each having its longest dimension located vertically.

Outside the upper part 32 and aligned vertically with it and slidable with respect to it, is a key 17 comprising a shaft and a plurality of wards 33. As illustrated, the number of wards 33 is three. Shaft portions 34 extend between the wards 33. The lowest ward 33 has an upwardly directed socket 35 in its lower surface, which socket 35 locates one end of a coil spring 36. The other end of the coil spring 36 is located in a downwardly directed but otherwise similar socket 7 of a base ring 23 fitted non-rotatably on neck 32. The coil spring 36 biasses the key 17 upwardly.

The alignment of key 17 is by means of lower peg 9 projecting through oval aperture 4 and slidable vertically in it, and upper peg 10 similarly projecting through oval aperture 5 and vertically slidable in it. Through sliding of pegs 9, 10 in apertures 4, 5, the key 17 has limited vertical upward and downward movement with respect to housing 3, the downward movement being against the bias of spring 36. Pegs 9, 10 are suitably in screw-threaded engagement with the key 17. A suitable limit of upward travel of key 17 is shown in FIGS. 2 and 4, and a suitable limit of downward travel is shown in FIGS. 3 and 5.

A latch 8 for an openable hinged lid 18 of the money box may be pivoted on upper peg 10. The lid 18 suitably is formed by half the cicular top of housing 3 and may be hinged diametrically across the top. Another part 22 of the top of the housing may be integral with it to close the top adjacent the lid 18. Conveniently the coin slot 40 is located between the lid 18 and the top part 22. A handle 56 may extend upwardly from the part 22.

The latch 8 may comprise a first order lever having a lug 37 projecting from one side of the fulcrum, i.e. peg 10 to engage, when lid 18 is closed (FIGS. 3 and 5), a catch 21 located on the underside of lid 18. When the lid 18 is open and key 17 is in its upper position, peg 10 has also moved into an upper position thereby causing relative movement between latch 8 and itself. Latch 8 pivots on peg 10 to rotate lug 37 away from catch 21 of lid 18. Thus, lid 18 may be raised into the position shown in FIGS. 3 and 5.

Coil spring 6 is attached, at one end, to the interior of housing 3 below the level of latch 8 and, at the other end, to a point 39 on the lever of latch 8 which point is on the other side of the fulcrum from the lug 37. Hooks may be formed at each end of coils spring 6 to engage in a hole in latch 8 at point 39 in a top corner thereof and to the interior of the housing.

The connection of spring 6 to the interior of the housing may suitably be at a level between the oval apertures 4, 5. This distance may be such that a coil spring of suitable length and strength may exert spring bias on the latch 8 to bias it toward its open position when the peg 10 is in its upper position, from which open position the latch 8 may be returned to the closed position by downward pressure on lid 18. A stop 50 is provided to ensure that the latch 8 does not pivot under bias of spring 6 too far. However, when the peg 10 is in its lower position the tension in the spring should not exert sufficient bias as to pivot the latch to disengage it.

The positions of independently rotatable operational rings 19, 12, 15 govern whether the key 17 is free to move between its upper and lower positions. These operational rings 19, 12, 15, are spaced vertically in relation to the wards 33 by fixed spacer rings 20 such that, when the lid 18 is closed and the key 17 is hence in its lower position, the operational rings 19, 12 are located adjacent shaft portions 34 of the key 17 and are freely rotatable therearound and the freely rotatable operational ring 15 is located above the key 17. All the operational rings 19, 12, 15 are provided with foam packing 52 to take up any slack and leave a clearance space for rotation.

Each of the operational rings 19, 12, 15 is provided with a slot 13 of sufficient size to permit passage of a corresponding ward 33 of the key 17 when the rings 19, 12, 15 are located around the neck 31 of the cylinder and around the key 17 aligned vertically on the neck 31.

When each of the rings 19, 12, 15, is rotated to align its slot 13 with the ward 33 immediately below it, (thus incidentally aligning the slots one with each other when the key has linearly spaced wards), the key the wards 33 are able to move upwardly through the slots 13 under the bias of spring 36 on key 17. Thus, peg 10 moves upwardly in oval aperture 5, latch 8 pivots on peg 10 into its open position as spring 6 extends with the upward movement of peg 10 to bias the latch 8 into its open position.

The upward movement of key 17 is restrained by stop ring 16 which is positioned above operational ring 15. Stop ring 16 is generally similar to spacer rings 20 but is provided with an inwardly directed stop flange 42 which lies flush with the top of cylinder 3. Thus stop flange 42 is flush with top part 22 of the cylinder and with lid 18, when closed. The stop ring 16 defines a space 44 below the stop flange into which the top ward of key 17 may rise.

Outer surfaces of rings 19, 12, 15 may be provided with various indicia 46 such as symbols, colours or braille markings. The location of a specific marking 47 on each ring is chosen to be the same distance from the slot 13 of that ring. Thus when the slots of all the rings are aligned, the specific markings are also aligned. When the specific markings are further aligned with a mark 48 on the cylinder 3, whose position is selected for the purpose, the slots 13 will be further aligned with the wards of the key 17.

In use, an operator starting with a closed money-box, may align the specific markings 47 of the rings 19, 12, 15 with the mark 48 on the neck 32 of the cylinder. The key 17 may the slide upwardly, its wards 33 moving within slots 13. Pegs 9 and 10, move upwardly in oval apertures 4, 5. Spring 6 extends as peg 10 moves upwardly and biasses latch 8 into the open position to release catch 21 of lid 18 which is permitted to open.

In closing, the operator pushes down lid 18 with the specific markings 47 and mark 48 aligned as described. The key 17 moves down with its wards 33 moving in aligned slots 13 until the wards are located adjacent spacer rings 20 and the slots are located adjacent shaft portions 34, or, in the case of ring 15, adjacent space 44. The operator may then rotate rings 19, 12, 15 so that their specific marking 47 are out of alignment and the slots 13 are no longer aligned with the wards 33. The key 17 is no longer free to move upwardly and the box is closed.

We claim:

1. A money saving box comprising a housing having an openable hinged lid at a top thereof and having an opening for the insertion of money; an elongate locking key including a shaft and wards and being vertically aligned with and slidable with respect to a cylindrical upper part of the housing, by means of upper and lower pegs of the key, respectively slidable in upper and lower similar oval apertures in the upper part of the housing; rotatable operating rings located around the upper part of the housing and the shaft of the key, the rings having slots to accomodate the wards of the key and indicia indicating alignment of the slots with the wards of the key, in which alignment the key is movable between an upper position and a lower position over a distance limited by the oval apertures, the key being spring biassed towards said upper position; and a latch pivotally arranged on the upper supporting peg such that, when the key is in said lower position, the latch is pivotally arranged to engage said lid, and such that, when the key is in said upper position, the latch is spring biassed to be pivotally arranged to disengage the lid.

2. A money saving box as claimed in claim 1, in which there are three operating rings and the key has three wards.

3. A money savings box as claimed in claim 1 or 2, in which the indicia are coloured areas or symbols.

4. A money savings box as claimed in claim 1 or 2, in which the indicia are braille symbols.

* * * * *